United States Patent [19]

Zietzschmann

[11] 4,094,406

[45] June 13, 1978

[54] PACKAGE FOR A GROUP OF ARTICLES

[75] Inventor: Jurgen Zietzschmann, Kordel, Germany

[73] Assignee: The Mead Corporation, Dayton, Ohio

[21] Appl. No.: 782,302

[22] Filed: Mar. 28, 1977

[51] Int. Cl.[2] ..... B65D 65/18

[52] U.S. Cl. ..... 206/432; 206/45.34; 206/434; 206/497; 206/815; 229/DIG. 12

[58] Field of Search ..... 229/DIG. 12; 206/45.33, 206/45.34, 427, 429, 431, 432, 434, 497, 815, 524.6

[56] References Cited

U.S. PATENT DOCUMENTS

| | | | |
|---|---|---|---|
| 2,980,245 | 4/1961 | Stoker, Jr. | 229/DIG. 12 |
| 3,154,827 | 11/1964 | Gentry | 206/815 |
| 3,233,725 | 2/1966 | Bixler | 229/DIG. 12 |
| 3,382,971 | 5/1968 | Johnson | 206/497 |
| 3,491,878 | 1/1970 | Britton et al. | 206/432 |
| 3,525,428 | 8/1970 | Stephan | 206/432 |
| 3,687,282 | 8/1972 | Owen | 229/DIG. 12 |

FOREIGN PATENT DOCUMENTS

| | | | |
|---|---|---|---|
| 691,904 | 8/1964 | Canada | 206/497 |
| 1,503,707 | 10/1967 | France | 206/432 |
| 1,106,266 | 3/1968 | United Kingdom | 229/DIG. 12 |

*Primary Examiner*—Stephen Marcus
*Assistant Examiner*—Bruce H. Bernstein
*Attorney, Agent, or Firm*—Walter M. Rodgers; Walter A. Rodgers

[57] ABSTRACT

A package for a group of articles, particularly bottles, cans, or the like, which is open at both ends and which is wrapped around the group of articles, and which consists of a substantially rectangular blank, formed from a film of plastic material having end portions to which strips of paperboard are secured. Locking apertures are formed in one end portion and locking tongues are formed in the other end portion and are inserted into the locking apertures whereby two oppositely disposed margins of the blank are adapted to be joined together to secure the wrapper.

14 Claims, 19 Drawing Figures

PACKAGE FOR A GROUP OF ARTICLES

BACKGROUND OF THE INVENTION

Figure 1:
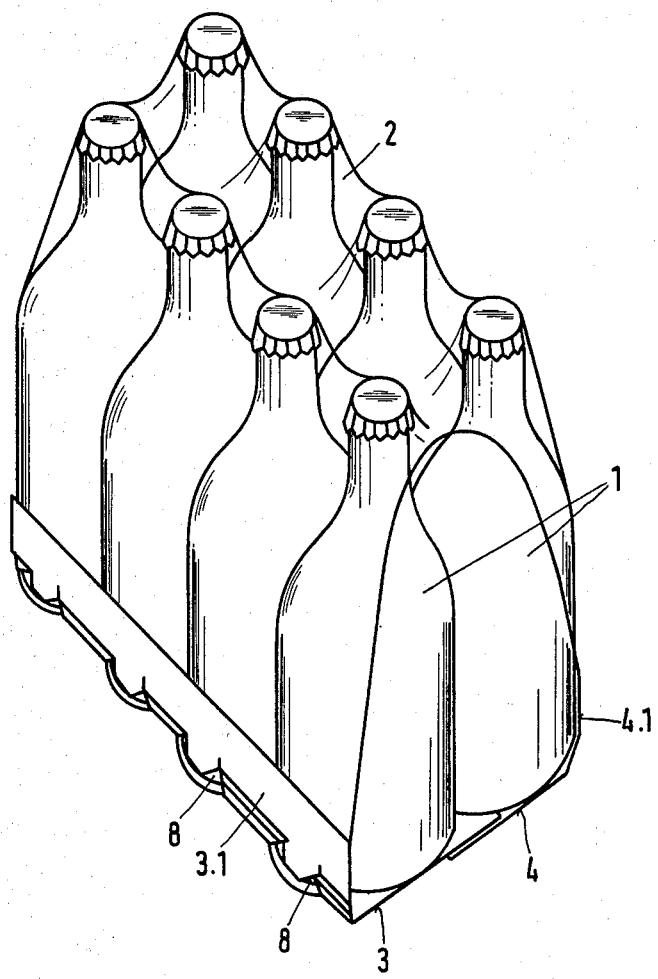

Up to the present time, certain wraparound packages have customarily consisted of a cardboard blank. The articles are visible only at the ends of the package, so that the carton must be printed upon in order to make the contents of the package known, since these packages customarily are packages for sale. In contrast, so-called shrink packages, which consist entirely of transparent shrink film, permit the contents of the package to be recognized; moreover, these shrink packages are cheaper than the above-mentioned packages made of cardboard. However, these shrink packages can be produced and closed only with relatively high expense for machinery and labor.

It is known to place the articles to be wrapped on a tray made of cardboard, corrugated board, or the like, in order to give the group of articles a better unity before the shrink film is applied, and to prevent the articles from falling apart after the shrink film has been torn off by the user. These packages require relatively lrge expense at the point of packaging, for a machine for setting up the tray, means for heat-sealing, cutting-off, and applying the shrink film, and a heating tunnel for the shrinking procedure are required.

It is also known to insert individual articles or several articles into a pre-fabricated, mechanically-stretched plastic film casing; when the streching tool is removed, the film embraces tightly the group of objects. A heating tunnel for a shrinking procedure is not necessary; here too, however, the expense for mechanical devices is relatively great, while the operating speed is low because of the discontinuous packaging operation.

It is common to all the above-mentioned types of packages that they are based either on paperboard as the packing material or on plastic film as the packing material, and therefore price fluctuations of the given packing material affect the price of the package produced, a change to other packaging materials not being possible without extensive mechanical alterations.

Therefore, it is the object of the invention to develop a package of the initially-mentioned type in such a manner that expense for machinery and labor is small at the point of packaging; that the package permits its contents to be easily recognized; and that, without alteration of the mechanical equipment at the point of packaging, an optimal selection of material is possible according to the price fluctuations of the materials employed.

According to the invention, this object is accomplished in that the blank is provided, at its two closure margins, with a closure strip consisting of paperboard, and that the intermediate area of the blank consist at least partially of a film of plastic material, which is joined to the paperboard closure strips.

The surface areas of the package which consist of film can be selected to vary in size and permit the contents of the package to be well recognized. For example, the blanks can be produced in large quantities, and therefore cost-favorably, in a central production plant on high-output equipment. They can be delivered, for example, individually or in the form of long, rolled-up strips which can be separated into individual blanks on tear lines as the latter are placed about the groups of articles. Alternatively, a composite web may be supplied, from which the blanks can be punched out as the first step in the packaging operation. Thus, the two materials, paperboard and film, do not have to be processed individually and successively at the point of packaging; rather, the completed blank is wrapped around the articles and secured. This permits very high operation speeds with great reliability because of the mechanical closure. Expense for machinery and labor at the point of packaging is therefore small, so that the package according to the invention can be used economically even in the case of small quantities of packages. Cost increases of paperboard can be compensated by selecting the proportion of paperboard to be relatively small and by limiting it to the two closure strips, for example. On the portions of the package consisting of paperboard, apertures, tear strips, mechanical locking means, and the like may be provided in the manufacture of the blanks with small expense for labor, which hitherto was not possible, or was possible only with great expense, in the case of conventional film packages.

Preferably, the plastic film used in encasing the groups of articles to be wrapped is an elastically-stretchable film. The time-consuming operations of heat-sealing and shrinking plastic film are eliminated, as the blank can be mechanically closed by means of the paperboard closure strips. The force with which the film is tightened about the articles is not supplied in a heating tunnel with high energy requirements, but rather mechanically, by stretching of the film; the energy requirement is substantially smaller; the operating speed can be greatly increased, because the procedure is a matter of a simple mechanical tensioning which can be performed rapidly. As an alternative, however, shrink film can be employed.

One embodiment of the invention concept provides that the plastic film be joined, at its edges, with an edge of the closure strips and, if desired, with an upper paperboard cover strip. This permits a relatively small proportion of film to be used. As an alternative, however, the plastic film may extend over the entire area of the blank and the closure strips and, if desired, the upper paperboard cover strip may be attached thereto by means of adhesive or by lamination.

In this way, the film imparts additional strength to the paperboard strips, so that a relatively thin and therefore inexpensive quality of paperboard can be employed.

Further advantageous embodiments of the concept of the invention are the subject matter of dependent claims.

The invention is explained below in more detail with reference to embodiments represented in the drawings.

Figure 2A:
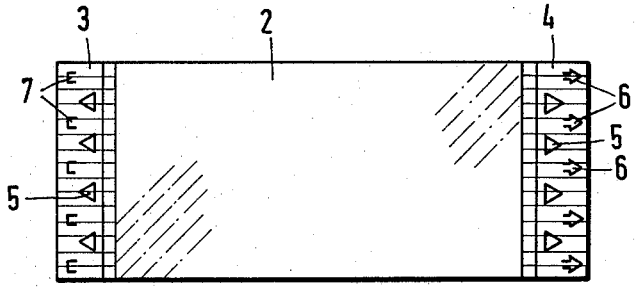
Figure 2B:
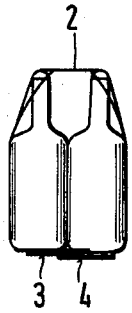
Figure 3A:
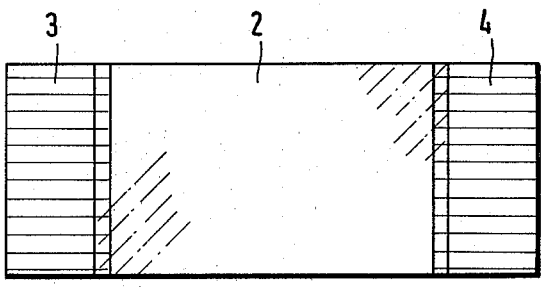
Figure 3B:
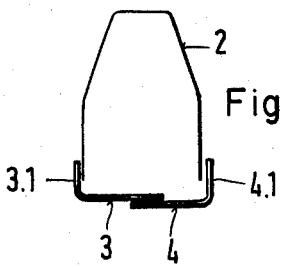
Figure 4A:
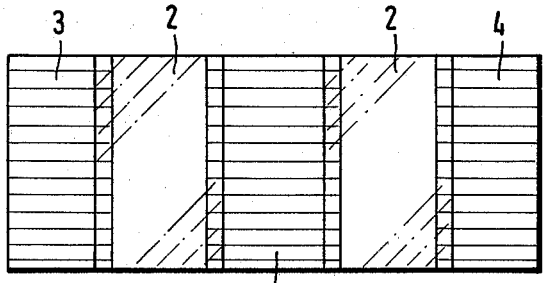
Figure 4B:
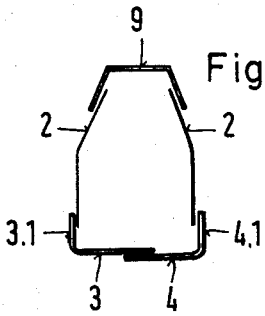
Figure 5A:
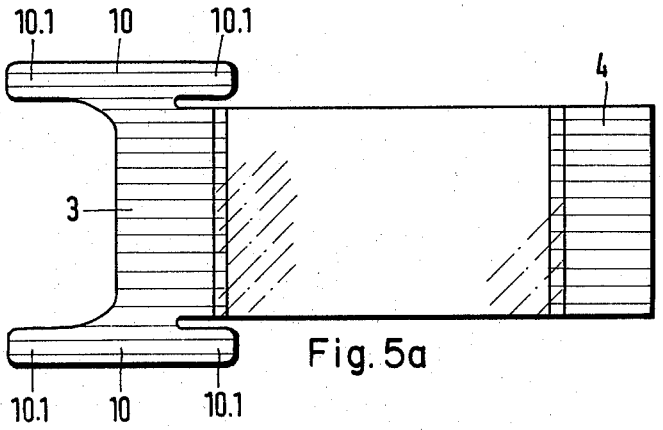
Figure 5B:
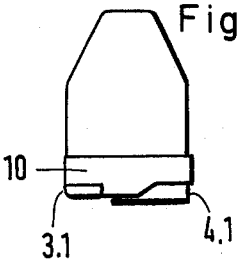
Figure 6A:
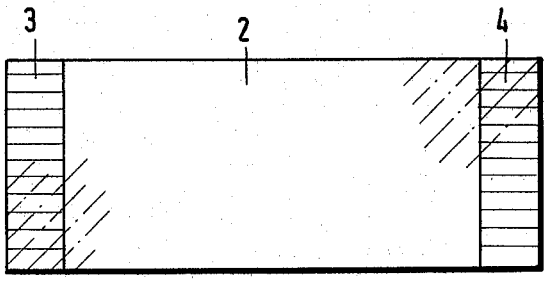
Figure 6B:
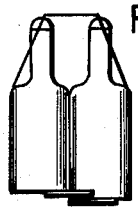
Figure 7A:
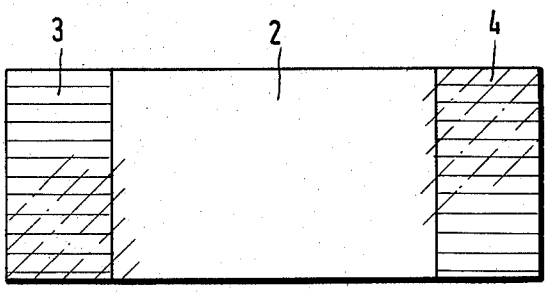
Figure 7B:
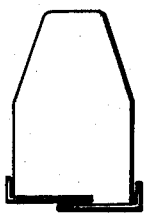

FIG. 1 shows, in perspective representation, a package for bottles in accordance with the invention;

FIGS. 2 and 5 show several examples of packages in accordance with the invention and illustrate a plan view of the blank in FIGS. 2*a*, 3*a*, 4*a*, and 5*a* and the end elevation of the package in FIGS. 2*b*, 3*b*, 4*b*, and 5*b*, whereby the film portions are adhered to the paperboard portions along narrow margins; and FIGS. 6*a* to 10*a* show several examples of blanks and FIGS. 6*b* – 10*b* show corresponding packages according to the invention in which the film extends over the entire blank.

In the example disclosed in FIG. 1, eight bottles 1 are assembled into one package unit; it goes without saying that another number of individual articles can be assembled into a package unit; for example, four or six bottles, cans, or the like. The articles can be arranged in one or more, preferably two, rows.

The wrapper comprises a plastic film 2, made of an elastically-stretchable plastic material, for instance, polyethylene. At both ends of each blank is placed a paperboard closure strip 3, 4, which, as represented in the example in FIG. 2*a*, has tightening apertures 5, in which pulling tools (not shown) of the packaging machine can engage in order to stretch the film 2 before and while it is being wrapped around the group of bottles 1, until the closure strips 3, 4 are joined to one another. Shrink film may also be used.

This joining may be accomplished in various ways; for example, by means of a contact adhesive or by means of a mechanical locking device which, in the example shown in FIG. 2*a* consists of arrow-shaped locking tongues 6 on the one closure strip 4, and of receiving apertures formed by U-shaped cuts 7 on the other closure strip 3; the tongues formed by the U-shaped cuts 7 lock the arrow-shaped tongues 6 after they have been inserted. In order to produce the connection, the arrow-shaped tongues 6 are simply pressed into the U-shaped cuts 7 and are locked therein.

In the embodiments according to FIGS. 3 to 10, the locking devices of the closure strips 3, 4 are not represented in detail; they can be produced in the same way as explained in connection with the example of FIG. 2; or other mechanical locking means, or an adhesive joint may be employed.

In the example according to FIG. 3, the closure strips 3, 4 are wider than in the example according to FIG. 2 and include lateral extensions 3.1 or 4.1 foldably joined to the bottom wall. As shown in FIG. 1, these extensions 3.1 and 4.1 may have retaining apertures 8, which receive the lower portions of the bottles and thereby hold the bottles in their positions in the package. In this instance, the lower portion of the extensions 3.1 or 4.1, which adjoin the bottom wall, is slightly inclined.

In order to obtain an upper paperboard cover for the bottles 1 or other articles, in the example according to FIG. 4, a paperboard cover strip 9, covering the tops of the articles 1, is arranged in the central area of the blank. The proportion of film section 2 is relatively small in this embodiment.

If a so-called tray is to be formed from paperboard, one of the two closure strips (the closure strip 3 in the example according to FIG. 5) may have at both ends, or both closure strips may have at opposite ends, a paperboard end strip 10 extending parallel to the longitudinal direction of the blank and foldably joined to the closure strip 3, and whose both ends are formed as tabs 10.1 which can be joined to the lateral extensions 3.1 and 4.1 folded up from the bottom. Suitably, the tabs 10.1 are glued to the extensions 3.1 and 4.1.

In the examples shown in FIGS. 2 to 5, the plastic film 2 is adhered to the adjacent paperboard strips 3, 4, 9 in only a narrow area. In contrast, in the embodiments according to FIGS. 6 to 10, the plastic film 2 extends over the entire area of the blank and is joined to the closure strips 3, 4 and, if desired, to the paperboard cover strip 9, by lamination, adhesive or heat sealing in known manner. In other respects, the embodiments according to FIGS. 6 and 7 correspond to the examples according to FIGS. 2 and 3.

Figure 8A:
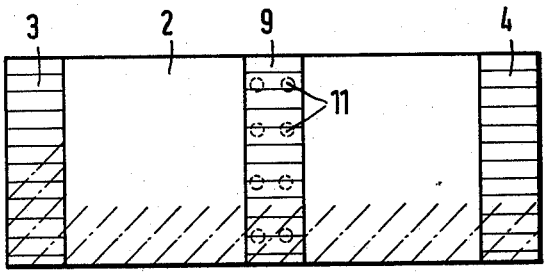
Figure 8B:
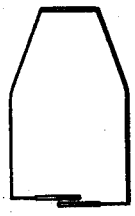

FIG. 8 shows an embodiment with a narrow paperboard cover strip 9, which lies only on the upper side of the package and has no folded-down edge portions. Apertures 11, which can be punched out in the production of the blank, are indicated by dashed lines in FIG. 8*a*, in order that, after the package has been completed, price tickets or similar labels can be attached to the individual articles through these apertures 11.

Figure 9A:
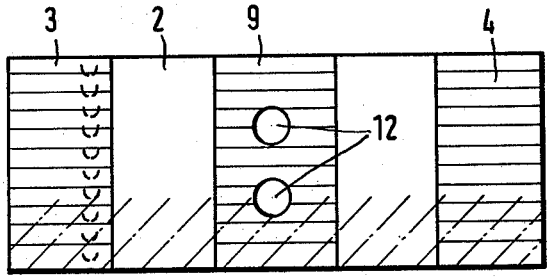
Figure 9B:
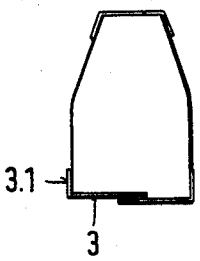

In the example according to FIG. 9, which resembles the example according to FIG. 4, finger gripping openings 12, which facilitate carrying of the package, are provided in the paperboard cover strip 9.

Figure 10A:
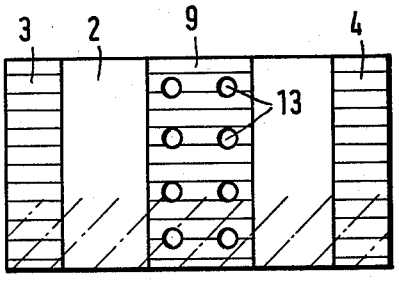
Figure 10B:
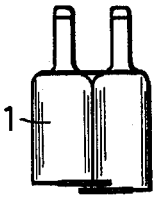

In the example shown in FIG. 10, the paperboard cover strip 9 has apertures 13 permitting the necks of the bottles 1 to extend therethrough so that the package acquires the form of cross-section indicated in FIG. 10*b*.

Also, the paperboard cover strip 9 may be omitted. While up to the present time, in the use of shrink packages, it is only possible to burn holes in the film on the completed package — for example, for labeling or marking purposes — in the package according to the invention, the apertures 13 for the bottles' necks can already be provided during the manufacture of the blanks, it being immaterial whether a paperboard cover strip 9 or only a film 2 is provided in the area of the necks of the bottles.

Since the packaging machine places the blank around the articles only by use of a tensioning force and has to join the closure strips 3, 4 at the ends of the blanks to one another, the embodiments according to FIGS. 2, 3, 4, 6, 7, 8 and 9 can be selectively used without alteration of the machine or the work routine, so that rapid conversion over to a greater proportion of cardboard or a greater proportion of film is possible, so that one can adjust oneself quickly to altered market situations and particularly price situations of raw materials. Alterations hereby must be undertaken only by the manufacturer of the blank.

In the example of package according to FIG. 10, it need only be assured that the bottle necks be inserted through the apertures 13 of the paperboard cover strip 9. An additional device on the packaging machine is required only when a change-over to a package according to FIG. 5 takes place, because there the tabs 10.1 will have to be folded and glued.

In the place of the finger gripping apertures 12 shown in FIG. 9a, other forms of gripping means may be provided on the paperboard cover strip 9; for example, folded-up handles or the like.

In the example according to FIG. 9, the upwardly folded extension 3.1 of the one closure strip 3 has a tear-open strip 14, which permits easy opening of the package. Such a tear strip can also be provided in all other embodiments of the invention in any of the paperboard strips.

What I claim is:

1. A package for a group of articles, particularly bottles, cans, or the like, comprising a wrapper placed around the group of articles and open at opposing ends, said wrapper being formed from a substantially rectangular blank which has two oppositely disposed closure portions adapted to be joined together for securing said wrapper, characterized in that the blank is provided at both of said closure portions with a closure strip (3, 4) made of paperboard and in that the area of said blank intermediate said closure portions having end portions and being partially of a film of plastic material (2) which is joined at its end portions to the closure strips (3, 4), and in that tightening apertures (5) are formed in said closure strips and in that locking tongues (6) are formed in one of said closure strips and apertures (7) are formed in the other of said closure strips said tongues received by said apertures to form said wrapper.

2. The package according to claim 1 characterized in that said plastic film (2) is an elastically stretchable film.

3. The package according to claim 1 characterized in that said plastic film (2) is a shrink film.

4. The package according to claim 1 characterized in that said closure strips (3, 4) are disposed at the bottom of the package.

5. The package according to claim 4 characterized in that a paperboard cover strip (9) is provided to extend over the tops of the articles (1) and is disposed in the central area of said blank.

6. The package according to claim 5 characterized in that neck-receiving apertures (13) are provided in said film (2) on the top of the package and in said paperboard cover strip (9).

7. The package according to claim 5 characterized in that apertures (11) for placing price tickets on the articles (1) are provided in said film (2) or in said paperboard cover strip (9).

8. The package according to claim 4 characterized in that finger gripping apertures (12) are provided in the paperboard cover strip (9).

9. The package according to claim 4 characterized in that said closure strips (3, 4) have upwardly-folded lateral extensions (3.1, 4.1) which may be provided with apertures (8) for retaining the lower portions of the articles (1).

10. The package according to claim 9 characterized in that at least one closure strip is foldably joined to an end strip (10) extending parallel to the longitudinal direction of the blank, the two ends of said end strip (10) being formed as tabs (10.1) which can be joined to the lateral extension strips (3.1, 4.1) extending upwardly from the bottom.

11. The package according to claim 1 characterized in that said plastic end portions joined to the closure strips are narrow edge portions.

12. The package according to claim 1 characterized in that said plastic end portions are joined to the closure strips over the entire area of said strips.

13. The package according to claim 1 characterized in that the plastic film (2) is joined to said closure strips (3, 4) by means of adhesive.

14. The package according to claim 1 characterized in that said plastic film (2) is joined to said closure strips (3, 4) by means of lamination.

* * * * *